United States Patent [19]

Horn et al.

[11] Patent Number: 4,649,361

[45] Date of Patent: Mar. 10, 1987

[54] ELECTRICAL COIL FORM WITH CONNECTOR SLEEVES

[75] Inventors: Günther Horn; Wolfgang Pieper, both of Wuerzburg; Heribert Roeser, Mainbernheim, all of Fed. Rep. of Germany

[73] Assignee: Siemens Aktiengesellschaft, Berlin and Munich, Fed. Rep. of Germany

[21] Appl. No.: 781,071

[22] Filed: Sep. 27, 1985

[30] Foreign Application Priority Data

Sep. 29, 1984 [DE] Fed. Rep. of Germany ..... 3435888

[51] Int. Cl.[4] ..... H01F 15/10; H01F 27/30

[52] U.S. Cl. ..... 336/192; 29/602 R; 336/208; 339/221 R

[58] Field of Search ..... 339/220 R, 220 C, 221 R, 339/221 M, 217 R, 218 R, 218 C, 218 M, 217 J; 336/192, 198, 208; 310/71; 29/602 R

[56] References Cited

U.S. PATENT DOCUMENTS

| | | | |
|---|---|---|---|
| 2,071,164 | 2/1937 | Galvao | 339/221 R X |
| 2,892,177 | 6/1959 | Schenny | 339/220 C |
| 3,054,027 | 9/1962 | Barrick et al. | 336/192 X |
| 3,120,418 | 2/1964 | Deakin | 339/221 R X |
| 3,328,745 | 6/1967 | Paullus | 339/220 R X |
| 3,332,048 | 7/1967 | Renskers | 336/192 X |
| 3,453,575 | 7/1969 | Davis | 336/192 |
| 3,470,511 | 9/1969 | Heinzen | 336/192 X |
| 3,659,254 | 4/1972 | Cartwright | 339/221 R |
| 3,932,828 | 1/1976 | Plunkett et al. | 336/96 |
| 4,105,985 | 8/1978 | Plunkett | 336/192 X |
| 4,122,424 | 10/1978 | Plunkett | 336/192 X |
| 4,394,637 | 7/1983 | Petroons | 336/192 |

FOREIGN PATENT DOCUMENTS

| | | | |
|---|---|---|---|
| 2758700 | 2/1980 | Fed. Rep. of Germany . | |
| 52684 | 6/1942 | Netherlands | 336/192 |
| 1185679 | 3/1970 | United Kingdom | 339/220 R |

OTHER PUBLICATIONS

IBM Technical Disclosure Bulletin, "Receptacle," Cargill et al., vol. 2, No. 4, Dec. 1959, 339-221, p. 14.

*Primary Examiner*—Thomas J. Kozma
*Attorney, Agent, or Firm*—F. W. Powers; J. L. James

[57] ABSTRACT

The invention specifies a coil form which assures the possibility of production by automated means, a strain-relieved connection between external connecting lines, which can pass in an insulated fashion through an opening of a surrounding motor stator housing, and the coil winding ends of an exciter winding wound on the coil form. For this purpose connector sleeves are inserted and fixed in place to radially continuous, stepped diameter, fitting openings in a locking plastic bracket which is hinged-mounted by a plastic hinge on one end flange and which, after the connection has been made, can be swiveled over the exciter coil winding and locked on the other end flange. Around one set of sleeve ends of the connector sleeves which project out of the internal operating side of the plastic bracket, the coil winding ends of the exciter coil are wound. In the other set of sleeve ends the insulation stripped ends of the external connecting lines are inserted to make contact from the exterior operating side of the plastic bracket.

24 Claims, 8 Drawing Figures

ELECTRICAL COIL FORM WITH CONNECTOR SLEEVES

BACKGROUND OF THE INVENTION

This invention relates to electrical coil forms and more particularly to electrical coil forms having molded-on plastic brackets into which connector sleeves are located for strain relieved connections with the ends of the electrical coil windings and also with the ends of external leads.

One type of coil form with a connector piece is known from U.S. Pat. No. 3,932,828. In the coil form specified in U.S. Pat. No. 3,932,828 a plastic terminal block is fixed-mounted to one end flange in such a way that one set of connector sleeve ends project beyond the internal working side of the plastic block and are located radially above the compartment the coil is to be wound in and therefore impede the insertion of the coil winding within the winding compartment, especially when using automatic winding machines. The connector sleeves themselves are inserted from the external working side of the plastic block in the fitting openings located on said side having a larger opening diameter strain relief. Projection against tension exerted by the external connecting lines is provided primarily by bending the straps after inserting the sleeves around the sleeve ends which project beyond the internal working side of the plastic bracket. Protection against the sleeves slipping through when inserted from the external working side of the plastic block is provided by a collar rim to be separately mounted on the sleeves, which mates at the inner end of the fitting opening mating part having a larger opening diameter on a step-formed indentation. To cover and insulate the free ends of the sleeves, which project beyond the winding compartment, an insulating encapsulant is applied axially.

In another coil form known from German Pat. No. 2,758,700, during the injection molding, tongue-shaped connector pins are molded simultaneously with a hinge-like plastic bracket to the coil form. In the operating position of the plastic bracket, after it has been swung on its hinged axis over the winding compartment against the one end flange and which catches in the other end flange, the winding ends of the exciter coil wound in the coil form are connected to the radially inward projecting internal terminals; a plug attached to an external connecting leads can be mounted onto the radially outwards projecting external terminals of the injection-molded connecting pins.

It is the object of this invention to simplify the fabrication of the coil form and to ensure reliable strain-relieved contact between the winding ends of the coil wound on the coil form on the one hand and the connecting ends of the external connecting leads on the other hand, particularly for purposes of automated fabrication and assembly of a completed coil.

SUMMARY OF THE INVENTION

Briefly stated, in accordance with one aspect of the invention, the foregoing objects are achieved by providing a coil form designed for a coil having a U-shaped winding compartment, opened radially outward, limited axially by end flanges; a plastic bracket formed onto one end flange with internally positioned single-unit connector means to connect external connecting leads on the one hand and coil winding ends on the other; stepped diameter, but radially continuous, fitting openings in the plastic bracket, into which connector sleeves are inserted and fixed in place as connector means; around one end of each connector sleeve projecting from the internal operating side of the plastic bracket the coil winding ends are wound, while in the end of each connector other sleeve the insulated ends of the operating external lines are inserted from the operating external side of the plastic bracket in order to make contact. The coil form is further characterized by the fitting openings each possessing an offset, reduced inside diameter in the vicinity of the external operating side of plastic bracket; the connector sleeves are inserted from the internal side of the plastic bracket into a first plurality of fitting opening mating part each having a greater inside diameter until each mates with a second plurality of fitting opening mating parts each having a lesser inside diameter; and the plastic bracket is hinge-mounted on one end flange and can be swivelled back laterally away from the winding compartment for the connector sleeves to make contact with the winding ends of the coil; and can be swivelled back over the winding compartment and locked into place with the other end flange.

The insulated ends of the external lines, which without requiring any large assembly area can be inserted parallel to the end side of the coil form into the connector sleeves from the upper side of the plastic bracket which has been swivelled to the side, can be brought in contact with the connector sleeves in a particularly simple fashion by having one set of projecting sleeve ends which have been wrapped with the coil winding ends dipped in a downwards direction into a solder bath, whereby through the capillary or wicking action the liquid solder material rises upward to the insulated ends of the external lines which have been inserted in the connector sleeves so that they will also make an assured contact to the connector sleeves in the same fabrication step. A particularly simple fabrication and assembly procedure, which nevertheless ensures fully effective strain relief, is attained in said process by having the connector sleeves mate in a form-fitting fashion against the stop defined by the fitting opening mating part with the lesser inside diameter, which would come into play given an external tension acting on the external connecting lines. Thus, obviating the need for any additional mating collar rim on the connector sleeves, while simultaneously ensuring particularly good strain relief since the simple cylindrical connector sleeve mates with the smaller fitting opening mating part in the step-formed offset of the fitting opening mating part against the tensile direction of the external connecting lines. Simultaneously an insulated routing of the external connecting line out of the plastic bracket is guaranteed if the insulated ends of said connecting lines are shorter than the bore depth of the fitting opening mating part with the lesser inside diameter.

To ensure particularly good strain relief and correspondingly to ensure a particularly good mechanical attachment of the connector sleeves in the plastic bracket which following contact with the connectors has been swung back over the winding and secured on the other end flange, the design provides that the connector sleeves are slotted longitudinally in order to have a slight spring action in the circumferential direction and can thus be inserted with tension into the fit opening. In addition, in accordance with a further embodiment of the invention, the design provides for further mechanical fixation the outer surfaces of the connector sleeves are equipped with a grid pattern which is pressed into the surrounding softer plastic of the plastic bracket when inserting the connector sleeves.

To assure the largest possible spacing and thus good unobstructed access of the coil winder machine to the one set of sleeve ends projecting from the plastic bracket, the design provides for reducing the connector sleeves in the area of their projecting set of sleeve ends to semi-circular residual sleeve parts and to arrange such a facing arrangement of numerous residual sleeve parts within a plastic bracket so that the semi-circular residual sleeve wall sections are arranged in the plastic bracket at the largest possible mutual spacing; at the same time this produces along the sharp outer edges of the semi-circular residual sleeve wall sections a simple means for separting the winding ends of the completely wound coil and the remaining winding wire held by the coil winder machine.

BRIEF DESCRIPTION OF THE DRAWINGS

While the specification concludes with claims particularly pointing out and distinctly claiming the subject matter which is regarded as the invention, it is believed that the invention will be better understood from the following description of the preferred embodiment taken in conjunction with the accompanying drawings in which:

DESCRIPTION OF A PREFERRED EMBODIMENT

Figure 1:
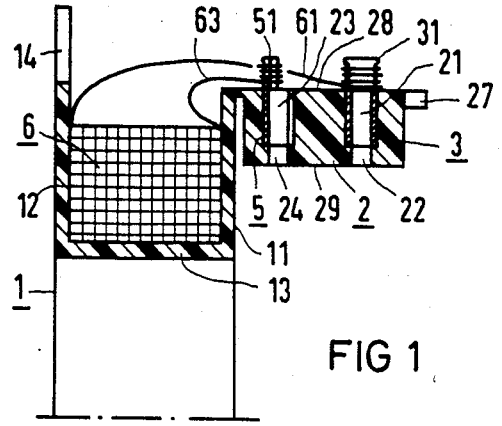
FIG. 1 is a partial section along section I—I of FIG. 2 of a coil form with a plastic bracket swivelled to the side, having molded-in connector sleeves and attached winding ends.

FIG. 1 shows, in a partial sectional view, an annular-shaped plastic coil form 1, whose winding compartment is limited axially by surrounding end flanges 11 and 12 respectively and along the inside circumference by a coil base 13. Within the winding compartment an exciter winding 6, e.g., of a pulse motor, is wound. At the radial outer edge of the right end flange 11 of the coil form 1 a plastic bracket 2 is injection-molded in one piece via a hinge-like joint. The plastic bracket is then swivelled leftwards on its joint over winding 6 after the winding connection has been made, and using interlocking lugs 27, 27 which are attached to it, mated with the interlocking catch segments 14, 14 molded-on in one piece to the left end flange 12 and thus the bracket is located in its operating position shown in FIG. 7 or FIG. 8.

To make contact between the winding ends 61, 62, 63 of exciter coil 6 and the external connecting lines 7, 8 and 9, three connector sleeves 3, 4, 5 are inserted in plastic bracket 2 at corresponding injection-molded fitting openings from the internal operating side 28 of plastic bracket 2. The fitting openings each consist of a first fitting opening mating part 21, 23 or 25 opened to the internal operating side 28 of plastic bracket 2 having a larger internal diameter and relatively large boring depth, and a second fitting opening mating part 22, 24 or 26 with a lesser inside diameter in the vicinity of the external operating side 29 of plastic bracket 2. By designing the fitting openings in this fashion, the design assures that on the one hand, the connector sleeves 3, 4 or 5, when inserted, come to rest against the offset formed by the second fitting opening mating part 22, 24 or 26 with its lesser inside diameter and thus are protected against any tensile strain from the external connecting lines 7, 8 and 9 to be introduced from the external side 29 of plastic bracket 2 in order to make contact; on the other hand, the external connecting lines 7, 8 and 9 can be inserted in connector sleeves 3, 4 and 5 in an insulated fashion in case their insulation stripped ends 71, 82 and 91 are not longer than the bore depth of the second fitting opening mating parts 22, 24 or 26.

Figure 2:
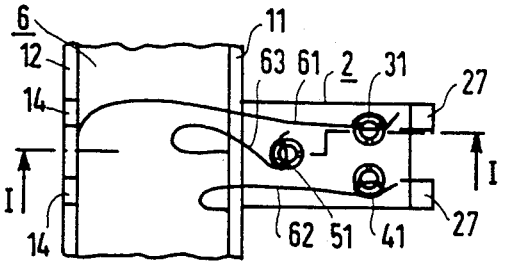
FIG. 2 is a partial plan view of a coil form with the swivelled plastic bracket in the swivelled to the side position.

FIG. 2 shows the set of three sleeve ends of connector sleeves 3, 4, 5 which project from the internal side 28 of plastic bracket 2, wherein the projecting one set of sleeve ends is reduced to semi-circular residual sleeve wall sections 31, 41 or 51. The residual sleeve wall sections 31, 41 or 51 are mutually positioned in such a manner to assure maximum spacing between them and thus assure the largest possible free space for the coil winding machine when wrapping the residual sleeve wall sections 31, 41 or 51 with winding ends 61, 62 or 63 respectively of exciter coil 6. At the same time it should be clear that due to the sharp outside edges of the partly circular residual sleeve sections 31, 41 or 51, a slight additional tension easily permits a separation between the winding ends and the remaining winding wire held by the coil winding machine.

Figure 3:
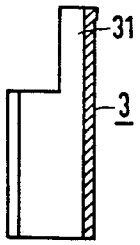
FIG. 3 illustrates a longitudinal section along section III—III of FIG. 4 of a single connector sleeve.
Figure 4:
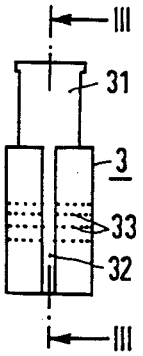
FIG. 4 shows a front view of an individual plug-in sleeve.
Figure 5:
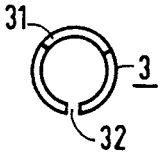
FIG. 5 shows a front plan view of an individual plug-in sleeve in accordance with FIG. 4.

FIGS. 3 through 5 show an individual connector sleeve 3 with its one residual sleeve wall section 31 projecting in a partly circular pattern from the internal side 28 of plastic bracket 2, with an axial longitudinal slot 32 through which the sleeve wall is given a spring action so that its insertion into the corresponding fitting opening 21 of plastic bracket 2 is ensured in a friction-locked fashion, and with a grid pattern 33 designed to press into the surface of the sleeve wall to provide additional retaining force.

Figure 6:
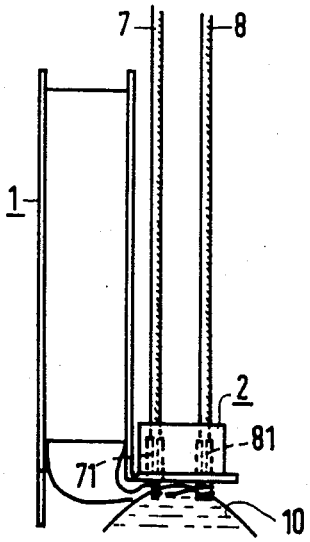
FIG. 6 illustrates the coil form rotated in contrast to FIG. 1 by 180 degrees, with one set of sleeve ends projecting from the plastic bracket and immersed in a solder bath.

After the winding ends 61, 62 or 63 have been wound around their respective partly circular residual sleeve wall sections 31, 41 or 51 and have established preliminary contact with connector sleeves 3, 4 or 5, once the plastic bracket 2 as shown in FIG. 1 has been swung laterally, —assuming that this contacting has taken place in the coil form position shown in FIG. 1—the coil form is then rotated by 180 degrees so that the residual sleeve wall sections wrapped with the winding ends can be immersed in a simple fashion, as shown in FIG. 6, into a dip-solder bath 10. The previously inserted external connecting lines, which were introduced with their insulated ends 71, 81 or 91 into the respective connector sleeves 3, 4 or 5 of the operating external side of plastic bracket 2 in accordance with FIG. 6 parallel to the end flange 12, are thus automatically connected electrically with the inner wall sections of the connector sleeves as well and mechanically fastened, since due to the capillary/wicking action of the sleeves the liquid solder material rises up to the insulation of the insulation stripped ends of the external connecting lines in the sleeves.

Figure 7:
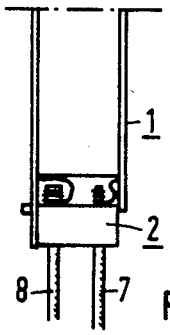
FIG. 7 illustrates a side view of the complete coil form with the plastic bracket swivelled into its locked position.
Figure 8:
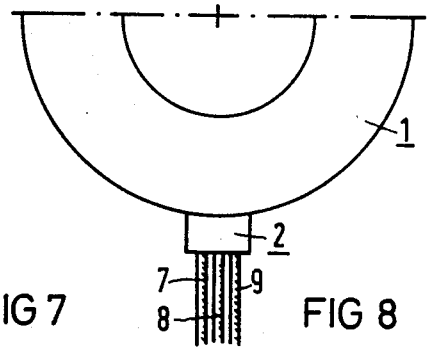
FIG. 8 illustrates a front plan view of the completed coil form in accordance with FIG. 7.

FIGS. 7, 8 show the completed coil form 2 after it has been swivelled around over winding 6 and locked in place on the other end flange of coil form 1 once the connection between the winding ends and the external connecting lines has been established.

It will now be understood that there has been disclosed an improved electrical coil form which is readily fabricated and onto which a coil is readily assembled by non-automated automated means. As will be evident from the foregoing description, certain aspects of the invention are not limited to the particular details of the examples illustrated, and it is therefore contemplated that other modification or applications will occur to those skilled in the art. It is accordingly intended that the claims shall cover all such modifications and applications as do not depart from the true spirit and script of the invention.

What is claimed as new and desired to be secured by Letters Patent of the United States is:

1. A coil form for use with a coil having a U-shaped winding compartment opened radially outward limited axially by end flanges; a plastic bracket formed onto one end flange with internally positioned single-unit connector means to connect external connecting leads on the one hand and coil winding ends on the other; stepped diameter, but radially continuous, fitting openings in the plastic bracket, into which connector sleeves are inserted and fixed in place as connector means; around one end of each connector sleeve, projecting from the internal operating side of the plastic bracket, the coil winding ends are wound, while in the other end of each connector other sleeve the insulated ends of the external operating lines are inserted from the external operating side of the plastic bracket in order to make contact, further characterized by:

(a) the fitting openings each possess an offset, reduced inside diameter in the vicinity of the external operating side of plastic bracket;

(b) the connector sleeves are inserted from the internal side of the plastic bracket into a first plurality of fitting opening mating part each having a greater inside diameter until each mates with a second plurality of fitting opening mating parts each having a lesser inside diameter; and (c) the plastic bracket is hinge-mounted by a plastic hinge on the one end flange and can be swivelled back laterally away from the winding compartment for the connector sleeves to make contact with the winding ends of the coil; and can be swivelled back over the winding compartment and locked into place with the other end flange.

2. A coil form according to claim 1, further characterized by the connector sleeves having a longitudinal slot therein.

3. Coil form according to claim 1, further characterized by the connector sleeves each having an external surface outfitted with a grid pattern in an area which penetrates the plastic bracket when inserted.

4. Coil form according to claim 2, characterized by the connector sleeves each having an external surface outfitted with a grid pattern in an area which penetrates the plastic bracket when inserted.

5. Coil form according to claim 1, further characterized by the connector sleeves each having a reduction area of each sleeve end which projects outwards to a partly circular residual sleeve wall section.

6. Coil form according to claim 2, further characterized by the connector sleeves each having a reduction area of each sleeve end which projects outwards to a partly circular residual sleeve wall section.

7. Coil form according to claim 3, further characterized by the connector sleeves each having a reduction area of each sleeve end which projects outwards to a partly circular residual sleeve wall section.

8. Coil form according to claim 4, further characterized by the connector sleeves each having a reduction area of each sleeve end which projects outwards to a partly circular residual sleeve wall section.

9. Coil form according to claim 5, further characterized by a mutual arrangement of the connector sleeves within the plastic bracket having the partly circular residual sleeve wall sections arranged with a maximum possible mutual spacing in the plastic bracket.

10. Coil form according to claim 6, further characterized by a mutual arrangement of the connector sleeves within the plastic bracket having the partly circular residual sleeve wall sections arranged with a maximum possible mutual spacing in the plastic bracket.

11. Coil form according to claim 7, further characterized by a mutual arrangement of the connector sleeves within the plastic bracket having the partly circular residual sleeve wall sections arranged with a maximum possible mutual spacing in the plastic bracket.

12. Coil form according to claim 8, further characterized by a mutual arrangement of the connector sleeves within the plastic bracket having the partly circular residual sleeve wall sections arranged with a maximum possible mutual spacing in the plastic bracket.

13. Coil form according to claim 1, further characterized by a plurality of external connecting lines with insulation stripped ends, each respectively in each said connector sleeves, and the coil winding ends, which are wound around the free ends of the connector sleeves, soldered by immersion of the projecting sleeve ends wrapped with the coil winding ends along with the connector sleeves in a dip-soldering bath.

14. Coil form according to claim 2, further characterized by a plurality of external connecting lines with insulation stripped ends, each respectively in each said connector sleeves, and the coil winding ends, which are wound around the free ends of the connector sleeves, soldered by immersion of the projecting sleeve ends wrapped with the coil winding ends along with the connector sleeves in a dip-soldering bath.

15. Coil form according to claim 3, further characterized by a plurality of external connecting lines with insulation stripped ends, each respectively in each said connector sleeves, and the coil winding ends, which are wound around the free ends of the connector sleeves, soldered by immersion of the projecting sleeve ends wrapped with the coil winding ends along with the connector sleeves in a dip-soldering bath.

16. Coil form according to claim 4, further characterized by a plurality of external connecting lines with insulation stripped ends, each respectively in each said connector sleeves, and the coil winding ends, which are wound around the free ends of the connector sleeves, soldered by immersion of the projecting sleeve ends wrapped with the coil winding ends along with the connector sleeves in a dip-soldering bath.

17. Coil form according to claim 5, further characterized by a plurality of external connecting lines with insulation stripped ends, each respectively in each said connector sleeves, and the coil winding ends, which are wound around the free ends of the connector sleeves, soldered by immersion of the projecting sleeve ends wrapped with the coil winding ends along with the connector sleeves in a dip-soldering bath.

18. Coil form according to claim 6, further characterized by a plurality of external connecting lines with insulation stripped ends, each respectively in each said connector sleeves, and the coil winding ends, which are wound around the free ends of the connector sleeves, soldered by immersion of the projecting sleeve ends wrapped with the coil winding ends along with the connector sleevves in a dip-soldering bath.

19. Coil form according to claim 7, further characterized by a plurality of external connecting lines with insulation stripped ends, each respectively in each said connector sleeves, and the coil winding ends, which are wound around the free ends of the connector sleeves, soldered by immersion of the projecting sleeve ends wrapped with the coil winding ends along with the connector sleeves in a dip-soldering bath.

20. Coil form according to claim 8, further characterized by a plurality of external connecting lines with insulation stripped ends, each respectively in each said connector sleeves, and the coil winding ends, which are wound around the free ends of the connector sleeves, soldered by immersion of the projecting sleeve ends wrapped with the coil winding ends along with the connector sleeves in a dip-soldering bath.

21. Coil form according to claim 9, further characterized by a plurality of external connecting lines with insulation stripped ends, each respectively in each said connector sleeves, and the coil winding ends, which are wound around the free ends of the connector sleeves, soldered by immersion of the projecting sleeve ends wrapped with the coil winding ends along with the connector sleeves in a dip-soldering bath.

22. Coil form according to claim 10, further characterized by a plurality of external connecting lines with insulation stripped ends, each respectively in each said connector sleeves, and the coil winding ends, which are wound around the free ends of the connector sleeves, soldered by immersion of the projecting sleeve ends wrapped with the coil winding ends along with the connector sleeves in a dip-soldering bath.

23. Coil form according to claim 11, further characterized by a plurality of external connecting lines with insulation stripped ends, each respectively in each said connector sleeves, and the coil winding ends, which are wound around the free ends of the connector sleeves, soldered by immersion of the projecting sleeve ends wrapped with the coil winding ends along with the connector sleeves in a dip-soldering bath.

24. A coil form for use with a coil, comprising a U-shaped winding compartment opened radially outward and limited axially by end flanges; a plastic bracket formed onto one end flange with internally positioned single-unit connector means to connect external connection leads on the one hand and coil winding ends on the other; said plastic bracket having stepped diameter, radially continuous fitting openings into which connector sleeves are inserted and fixed in place; the coil winding ends being wound around one end of each connector sleeve which projects from the internal operating side of the plastic bracket and in the other end of each connector other sleeve and insulated ends of the external operating lines are inserted from the external operating side of the plastic bracket in order to make contact;

the fitting openings each possessing an offset, reduced inside diameter in the vicinity of the external operating side of plastic bracket;

the connector sleeves being inserted from the internal side of the plastic bracket into a first plurality of fitting opening mating parts each having a greater inside diameter until each mates with a second plurality of fitting opening mating parts each having a lesser inside diameter, the connector sleeves each having a reduction area of each sleeve and which projects outwards to a partly circular residual sleeve wall section, the connector sleeves being mutually arranged within the plastic bracket having the partly circular residual sleeve wall sections arranged with a maximum possible mutual spacing in the plastic bracket; and the plastic bracket being hinge-mounted by a plastic hinge on the one end flange and being swivelly movable laterally away from the winding compartment for the connector sleeves to make contact with the winding ends of the coil and being swivelly moveable back over the winding compartment and locked into place with the other end flange.

* * * * *